US007131895B2

(12) United States Patent
Elmufdi et al.

(10) Patent No.: US 7,131,895 B2
(45) Date of Patent: Nov. 7, 2006

(54) CMP PAD HAVING A RADIALLY ALTERNATING GROOVE SEGMENT CONFIGURATION

(75) Inventors: Carolina L. Elmufdi, Glen Mills, PA (US); Jeffrey J. Hendron, Elkton, MD (US); Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/134,580

(22) Filed: May 20, 2005

(65) Prior Publication Data

US 2006/0154574 A1 Jul. 13, 2006

Related U.S. Application Data

(63) Continuation-in-part of application No. 11/036,263, filed on Jan. 13, 2005, now abandoned.

(51) Int. Cl.
*B24B 1/00* (2006.01)

(52) U.S. Cl. ..... 451/103; 451/285; 451/527; 451/530

(58) Field of Classification Search ..... 451/551, 451/548, 550, 921, 450, 488, 285, 526, 530, 451/531, 103, 527
See application file for complete search history.

(56) References Cited

U.S. PATENT DOCUMENTS

| | | | | |
|---|---|---|---|---|
| 5,690,540 | A | 11/1997 | Elliott et al. | |
| 5,921,855 | A | 7/1999 | Osterheld et al. | |
| 5,990,012 | A * | 11/1999 | Robinson et al. | 438/692 |
| 6,120,366 | A | 9/2000 | Lin et al. | |
| 6,159,088 | A * | 12/2000 | Nakajima | 451/527 |
| 6,241,596 | B1 | 6/2001 | Osterheld et al. | |
| 6,315,857 | B1 | 11/2001 | Cheng et al. | |
| 6,354,919 | B1 | 3/2002 | Chopra | |
| 6,520,847 | B1 | 2/2003 | Osterheld et al. | |
| 6,648,743 | B1 | 11/2003 | Burke | |
| 6,685,548 | B1 | 2/2004 | Chen et al. | |
| 6,729,950 | B1 * | 5/2004 | Park et al. | 451/528 |
| 6,783,436 | B1 * | 8/2004 | Muldowney | 451/41 |
| 6,843,709 | B1 | 1/2005 | Crkvenac et al. | |
| 6,843,711 | B1 * | 1/2005 | Muldowney | 451/527 |
| 6,955,587 | B1 * | 10/2005 | Muldowney | 451/41 |
| 6,958,002 | B1 * | 10/2005 | Palaparthi | 451/36 |

FOREIGN PATENT DOCUMENTS

KR 2002-0022198 A 3/2002

OTHER PUBLICATIONS

US 6,273,808, 08/2001, Bennett et al. (withdrawn)

* cited by examiner

*Primary Examiner*—Jacob K. Ackun, Jr.
(74) *Attorney, Agent, or Firm*—Blake T. Biederman

(57) ABSTRACT

A polishing pad (104) having an annular polishing track (122) and including a plurality of grooves (148) that each traverse the polishing track. Each groove includes a plurality of flow control segments (CS1–CS3) and at least two discontinuities in slope (D1, D2) located within the polishing track.

10 Claims, 17 Drawing Sheets

CMP PAD HAVING A RADIALLY ALTERNATING GROOVE SEGMENT CONFIGURATION

This application is a continuation-in-part of application Ser. No. 11/036,263 filed Jan. 13, 2005, now abandoned.

BACKGROUND OF THE INVENTION

The present invention generally relates to the field of polishing. In particular, the present invention is directed to a chemical mechanical polishing (CMP) pad having a radially alternating groove segment configuration.

In the fabrication of integrated circuits and other electronic devices, multiple layers of conducting, semiconducting and dielectric materials are deposited onto and etched from a semiconductor wafer. Thin layers of conducting, semiconducting and dielectric materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers, the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

Some designers of rotational CMP pads have designed pads having groove configurations that include two or more groove configurations that change from one configuration to another based on one or more radial distances from the center of the pad. These pads are touted as providing superior performance in terms of polishing uniformity and slurry utilization, among other things. For example, in U.S. Pat. No. 6,520,847 to Osterheld et al., Osterheld et al. disclose several pads having three concentric ring-shaped regions, each containing a configuration of grooves that is different from the configurations of the other two regions. The configurations vary in different ways in different embodiments. Ways in which the configurations vary include variations in number, cross-sectional area, spacing and type of grooves. In another example of prior art CMP pads described in Korean Patent Application Publication No. 1020020022198 to Kim et al., the Kim et al. pad includes a plurality of generally radial non-linear grooves that: (1) curve in the design rotational direction of the pad in a radially inward portion of the pad; (2) reverse curvature within the wafer track and (3) curve in the direction opposite the design rotational direction proximate the outer periphery of the pad. Kim et al. indicate that this groove configuration minimizes defects by rapidly exhausting byproducts of the polishing process.

Although pad designers have heretofore designed CMP pads that include two or more groove configurations that are different from one another or vary in different regions of the polishing layer, these designs do not directly consider benefits that may arise from varying the speed in which the polishing medium flows in the gap between the wafer and the pad across the width of the wafer track. Current research by the present inventor shows that polishing can be improved by permitting the polishing medium to flow relatively rapidly within the pad-wafer gap in one or more regions of the wafer track while inhibiting the flow of the polishing medium in one or more other regions of the wafer track. Consequently, there is a need for CMP polishing pad designs that control, and vary the speed of, the flow of polishing media within the pad-wafer gap.

STATEMENT OF THE INVENTION

In one aspect of the invention, a polishing pad is provided, comprising: a) a polishing layer configured for polishing at least one of a magnetic, optical and semiconductor substrate in the presence of a polishing medium, the polishing layer having a rotational center and including an annular polishing track concentric with the rotational center and having a width; and b) a plurality of grooves, located in the polishing layer, each traversing the entirety of the width of the annular polishing track and including an extrinsic curvature having at least two discontinuities within the annular polishing track, the at least two discontinuities being in opposite directions from one another and providing an increase and decrease in value of the extrinsic curvature, and having a first direction radially inward of the first discontinuity, a second direction in between the first discontinuity and the second discontinuity, and a third direction radially outward of the second discontinuity, and the change in direction between at least one pair of adjacent directions is from −85 degrees to 85 degrees.

In another aspect of the invention, the polishing pad as just described, wherein N represents a number and each groove has N discontinuities, N transitions occurring at the N discontinuities, and N+1 flow control segments located alternatingly with the N transitions, each of the N transitions having a width no greater than the width of the polishing track divided by 2N.

In a further aspect of the invention, a method of polishing at least one of a magnetic, optical and semiconductor substrate in the presence of a polishing medium is provided, including: polishing with a polishing pad, the polishing pad comprising: i) a polishing layer configured for polishing at least one of a magnetic, optical and semiconductor substrate in the presence of a polishing medium, the polishing layer having a rotational center and including an annular polishing track concentric with the rotational center and having a width, the annular track having at least three flow control zones; and ii) a plurality of grooves, located in the polishing layer, each traversing the entirety of the width of the annular polishing track and including an extrinsic curvature having at least two discontinuities within the annular polishing track, the at least two discontinuities being in opposite directions from one another and providing an increase and decrease in value of the extrinsic curvature, and having a first direction radially inward of the first discontinuity, a second direction in between the first discontinuity and the second discontinuity, and a third direction radially outward of the second discontinuity, and the change in direction between at least one pair of adjacent directions is from −85 degrees to 85 degrees; and b) adjusting removal rate of the substrate with each of the at least three flow control zones.

DETAILED DESCRIPTION OF THE INVENTION

Figure 1:
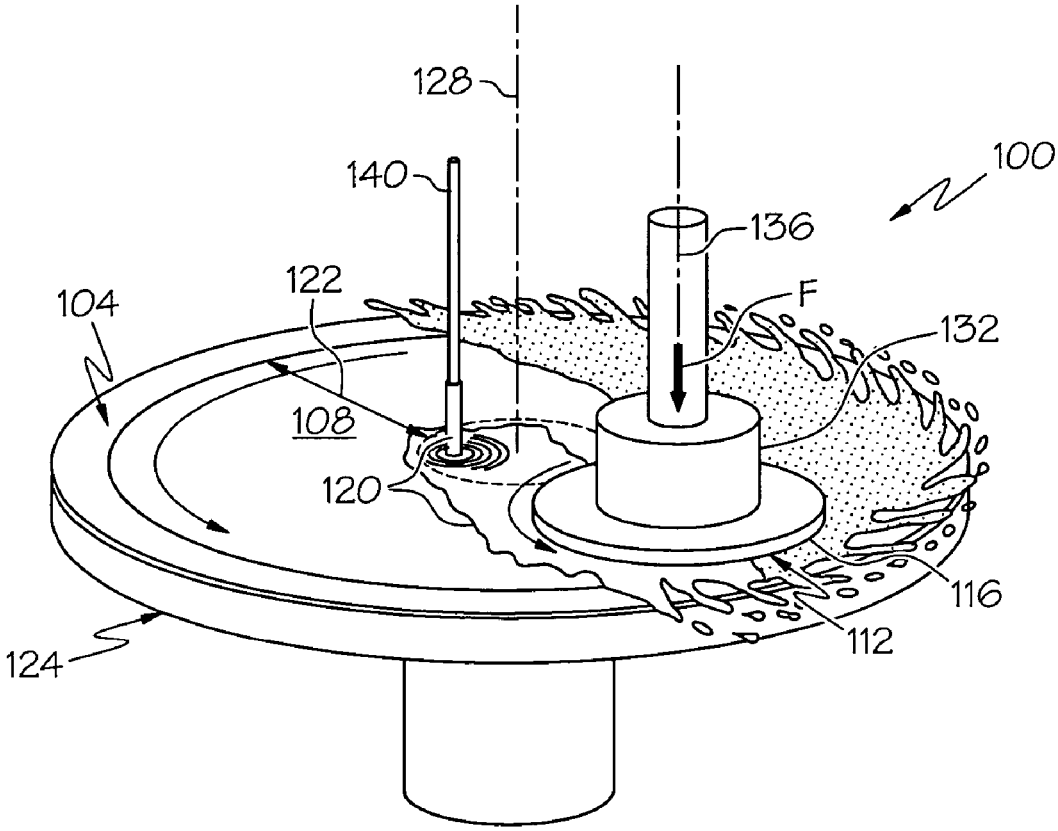
FIG. 1 is a perspective view of a portion of a dual-axis polisher suitable for use with the present invention.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 for engaging an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. For the sake of convenience, the term "wafer" is used below without the loss of generality. In addition, as used in this specification, including the claims, the term "polishing medium" includes particle-containing polishing solutions and non-particle-containing solutions, such as abrasive-free and reactive-liquid polishing solutions. Polishing layer 108 includes a typically annular wafer track, or polishing track 122, that is swept out by wafer 112 as polisher 100 rotates polishing pad 104 and wafer 112 is pressed against the pad.

As mentioned above and described below in detail, the present invention includes providing polishing pad 104 with a groove configuration (see, e.g., groove configuration 144 of FIG. 2A) that, essentially, varies the speed of polishing medium 120 within the pad-wafer gap across the width of polishing track 122. Varying the speed of polishing medium 120 in accordance with the present invention provides the designer of polishing pad 104 another option for varying residence times of the polishing medium in various regions of polishing track 122 to allow the designer more control over the polishing process.

Polisher 100 may include a platen 124 on which polishing pad 104 is mounted. Platen 124 is rotatable about a rotational axis 128 by a platen driver (not shown). Wafer 112 may be supported by a wafer carrier 132 that is rotatable about a rotational axis 136 parallel to, and spaced from, rotational axis 128 of platen 124. Wafer carrier 132 may feature a gimbaled linkage (not shown) that allows wafer 112 to assume an aspect very slightly non-parallel to polishing layer 108, in which case rotational axes 128, 136 may be very slightly askew. Wafer 112 includes polished surface 116 that faces polishing layer 108 and is planarized during polishing. Wafer carrier 132 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a polishing medium inlet 140 for supplying polishing medium 120 to polishing layer 108.

As those skilled in the art will appreciate, polisher 100 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the magnitude of force F applied between the wafer and pad, and (4) controllers, actuators and selectors for controlling the location of rotational axis 136 of the wafer relative to rotational axis 128 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 128, 136 and polishing medium 120 is dispensed from polishing medium inlet 140 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 112 and polishing pad 104.

Figure 2A:
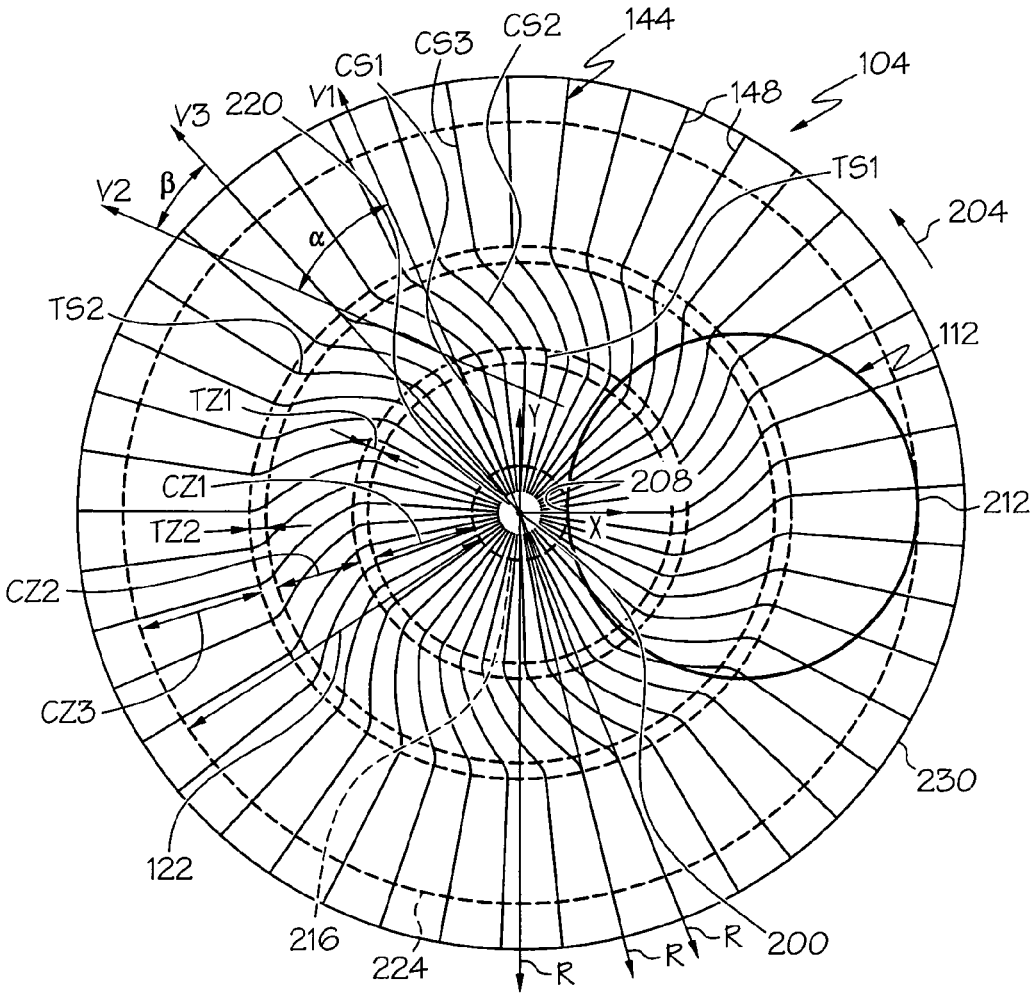
FIG. 2A is a plan view of a polishing pad of the present invention containing a plurality of grooves each having three flow control segments and two gradual discontinuities in slope within the polishing track.

FIG. 2A illustrates in connection with polishing pad 104 of FIG. 1, a groove configuration 144 that provides the pad with a plurality of grooves 148 containing a plurality of flow control segments CS1–CS3 each configured to control the flow speed of polishing medium 120 (FIG. 1) during polishing. The respective ones of flow control segments CS1–CS3 may be considered to lie in corresponding polishing medium flow control zones CZ1–CZ3 in which the polishing medium (not shown) flows at different speeds, depending upon the shape and direction (discussed more below) of the respective control segments in the zones.

In polishing pad 104 of FIG. 2A, flow control segments CS1 in polishing medium flow control zone CZ1 are configured to promote the flow of the polishing medium during polishing. Particularly, flow control segments CS1 are linear and radial relative to the rotational center 200 of polishing pad 104. Radial groove segments CS1 promote flow of the polishing medium by providing paths that align with the radial flow of the polishing medium that would tend to occur due to centrifugal force when polishing pad 104 is rotated at a constant speed, as typically occurs during polishing. As those skilled in the art will appreciate, if it is desired that flow control segments CS1 promote flow, they need not be radial, nor linear. For example, control segments CS1 may be curved and "wound," i.e., generally extending, in a direction in or opposite the design rotational direction 204, i.e., the direction polishing pad was designed to be rotated during polishing so as to obtain the desired effects of flow control segments CS1–CS3.

Flow control segments CS2 of polishing pad 104 shown are configured to inhibit the flow of the polishing medium during polishing when the polishing pad is rotated in design rotational direction 204. In this case, control segments CS2 are gently curved and are wound in design rotational direction 204. During polishing, as polishing pad 104 is rotated in design rotational direction 204, this configuration tends to retain the polishing medium in polishing medium flow control zone CZ2 until subjected to the effects of wafer 112 as it is rotated against the polishing pad. As those skilled in the art will appreciate, variables for flow control segment CS2 include curvature (or lack of curvature) and orientation (direction with respect to a radial line), i.e., direction of winding (clockwise, representing a negative angle, or counter-clockwise representing a positive angle), if any. Similar to flow control segments CS1, control segments CS2 need not inhibit flow of the polishing medium. On the contrary, they may be configured to promote flow of the polishing medium. For example, flow control segments CS2 may be radial or wound in a direction opposite design rotational direction 204.

In the embodiment shown, flow control segments CS3 in polishing medium flow control zone CZ3 are configured essentially the same as control segments CS1, i.e., they are linear and radial relative to rotational center 200 of polishing pad 104. Again, this radial configuration tends to promote flow of the polishing medium during polishing. Like flow control segments CS1 and CS2, control segments CS3 may have virtually any configuration that either promotes or inhibits flow of the polishing medium. It is noted that the effects of flow control segments CS1–CS3, i.e., either promoting flow or inhibiting flow, are relative, not absolute. That is, whether the flow control segments CS1–CS3 in any one of polishing medium flow control zones CZ1–CZ3 are considered as "flow promoting" or "flow inhibiting" is measured relative to the flow control segments in a next adjacent flow control zone. For example, in an alternative configuration (not shown), the groove segments CS1–CS3 in three adjacent polishing medium flow control zones CZ1–CZ3 may all be considered to be flow promoting in an absolute sense, e.g., the segments in one zone being radial and the segments in the other zone being wound in a direction opposite design rotational direction, but in a relative sense, one may be either flow promoting or flow inhibiting relative to the other. In other words, one configuration would promote flow better than the other.

Flow control segments CS1 and CS3 may be referred to as, respectively, "inner edge flow control segments" and "outer edge flow control segments," since they control the flow of the polishing medium in regions beneath and adjacent, respectively, the radially inward and outward edges 208, 212 (relative to polishing pad 104) of wafer 112 during polishing. Especially when a polishing medium is dispensed onto pad 104 radially inward of the inner circular boundary 216 of polishing track 122, inner edge flow control segments CS1 may extend across the inner boundary into the central region 220 of the pad. In this manner, inner edge flow control segments CS1 can aid in the movement of the polishing medium into polishing track 122. Similarly, when the circular outer boundary 224 of polishing track 122 is located radially inward from the outer periphery 230 of pad 104, outer edge flow control segments CS3 preferably extend across the outer boundary to aid in the movement of the polishing medium out of polishing track 122. In addition, it is noted that it is often, but not always, desirable that inner and outer edge flow control segments CS1, CS3 have the same orientation and curvature as each other so as to essentially treat the edge region of wafer 112 the same at the radially inward and outward regions of polishing track 122. In this context, orientation may be based upon the transverse centerline of the groove trajectory in the corresponding flow control segment CS1–CS3, and is measured by the angle it forms with respect to a radial line R (shown in FIG. 2A). Therefore, the orientation of two flow control segments can be compared whether the flow control segments are adjacent or not. For example, if flow control segment CS1 is radial and flow control segment CS3 is radial, they can be said to have the same orientation (even though they may not have the same direction). Curvature may be defined as the extrinsic curvature of that segment. Extrinsic curvature is described below in more detail.

Since the effects of flow control segments CS1–CS3 on the flow of the polishing medium differs from one polishing medium flow control zone CZ1–CZ3 to the next zone, it is often desirable to provide each groove 148 with a transition segment TS1, TS2 to transition one flow control segment CS1–CS3 to the immediately adjacent flow control segment. These transition segments TS1, TS2 may be considered to lie in annular transition zones TZ1, TZ2 located between corresponding ones of flow control zones CZ1–CZ3. In order to provide regions of different polishing medium flow speeds beneath wafer 112, i.e., within polishing track 122, it is readily seen that transition zone TZ1 must be contained entirely within the polishing track and spaced from inner boundary 216 of the polishing track so that at least a portion of flow control zone CZ1 lies within the polishing track. Likewise, if at least a portion of flow control zone CZ3 is to lie within polishing track 122, transition zone TZ2 must also be contained entirely within polishing track and spaced from outer boundary 224 of the polishing track.

Figure 2B:
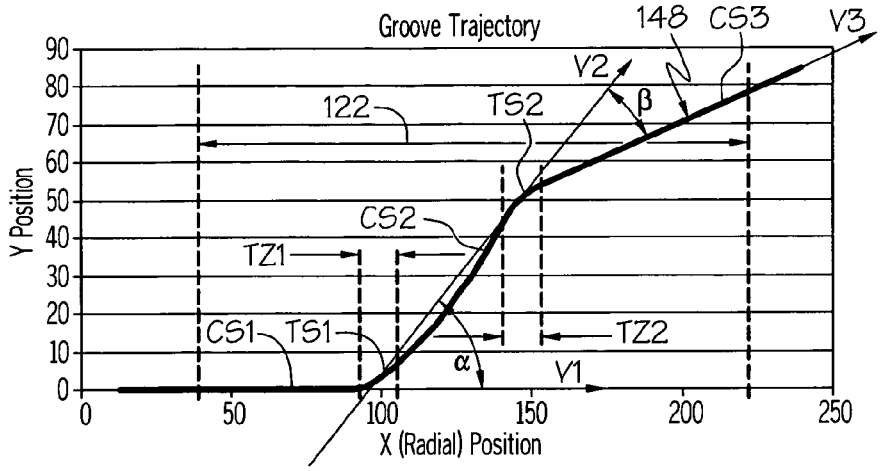
FIG. 2B is plot of the trajectory of each groove of FIG. 2A.
Figure 2C:
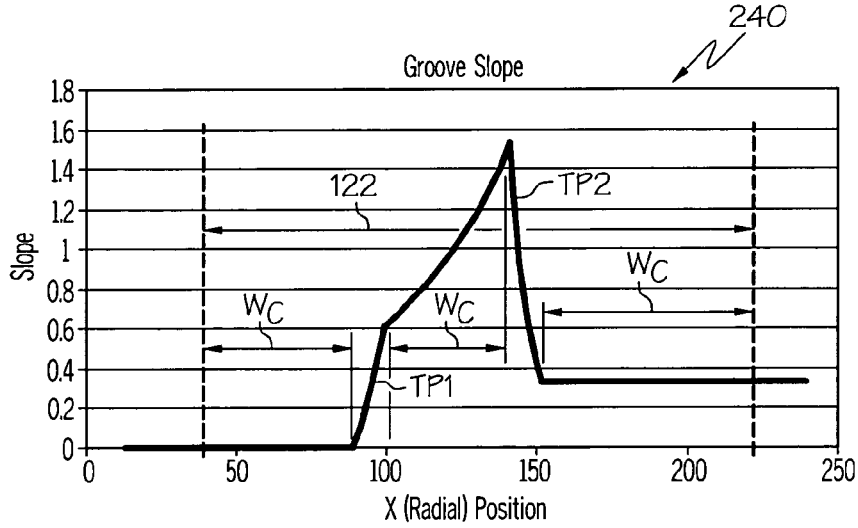
FIG. 2C is a plot of the slope of the trajectory of each groove of FIG. 2A.
Figure 2D:
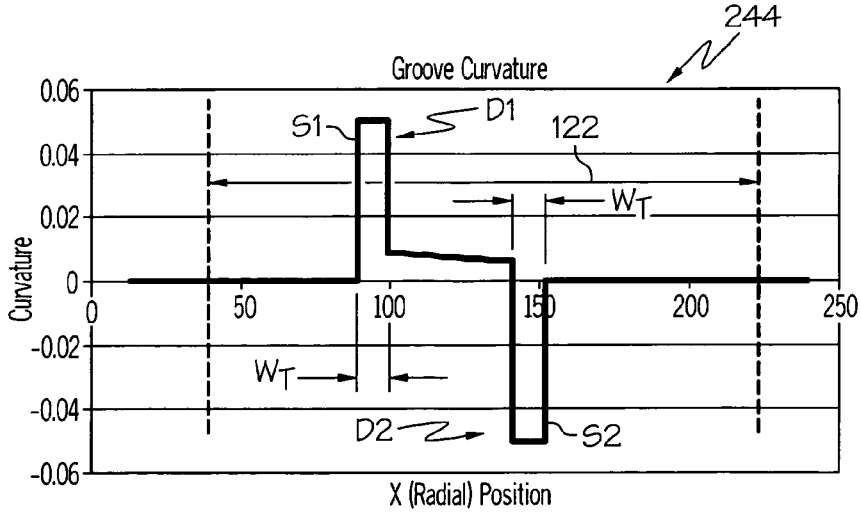
FIG. 2D is a plot of the extrinsic curvature of the trajectory of each groove of FIG. 2A.

Referring to FIGS. 2B–2D, and also to FIG. 2A, FIGS. 2B–2D illustrate how each groove 148 (reproduced in FIG. 2B) may be described in terms of its direction (FIG. 2B), slope (FIG. 2C) and its extrinsic curvature κ (FIG. 2D). The direction vector V1–V3 of each flow control segment CS1–CS3 is given by the transverse centerline of the groove trajectory in the respective flow control zone. Each direction vector V1–V3 forms an angle with respect to an adjacent direction vector. The angle α is formed by the intersection of direction vector V1 and direction vector V2. The angle β is formed by the intersection of direction vector V2 and direction vector V3. When the angles α and β are close to 90°, the flow of the polishing medium is impeded. This is particularly true when the change in direction between a pair of adjacent flow control segments is abrupt (corresponding to a small transition zone). Preferably, the change in direction, as measured by the angle formed by their respective direction vectors, between at least one pair of adjacent flow control segments is from −85° to 85° (−85° to 0° and 0° to 85°). More preferably, the change in direction, as measured by the angle formed by their respective direction vectors, between at least one pair of adjacent flow control segments is from −75° to 75° (−75° to 0° and 0° to 75°). Most preferably the change in direction between at least one pair of adjacent flow control segments is from −60° to 60° (−60° to 0° and 0° to 60°). Most preferably, these change in direction ranges apply to all adjacent flow control segments.

As is well known in mathematics, the slope of a plane curve is equal to the first derivative of the function that defines the curve. FIG. 2C is a slope plot 240 of the slope of groove 148 of FIG. 2B. Slope plot 240 will be described in more detail below in conjunction with the extrinsic curvature of grooves 148. As is also well known in mathematics, the extrinsic curvature κ of a plane curve at a given point on the curve is defined as the derivative of a tangent angle relative to the curve at that point. If θ(s) denotes the angle the curve makes with a fixed reference axis as a function of path length s along the curve, then $\kappa = d\theta/ds$. A plane curve may be defined using the Cartesian coordinates x and y, in which x and y are naturally scaled orthogonal coordinates, which means that $(ds)^2=(dx)^2+(dy)^2$ and $\theta=\tan(dy/dx)$. Consequently, $ds/dx=[1+(dy/dx)^2]^{1/2}$. Therefore, the curvature κ may be determined by directly evaluating the derivative dθ/ds as follows:

$$\begin{aligned}
\kappa &= \frac{d\theta}{ds} \\
&= \frac{dx}{ds}\cdot\frac{d\theta}{dx} \\
&= \frac{dx}{ds}\cdot\frac{d\left[\tan^{-1}\left(\frac{dy}{dx}\right)\right]}{dx} \\
&= \frac{1}{\sqrt{1+\left(\frac{dy}{dx}\right)^2}}\cdot\frac{\frac{d^2y}{dx^2}}{1+\left(\frac{dy}{dx}\right)^2} \\
&= \frac{\frac{d^2y}{dx^2}}{\left[1+\left(\frac{dy}{dx}\right)^2\right]^{3/2}}
\end{aligned}$$

FIG. 2D shows a curvature plot 244 of curvature κ versus radial position along groove 148 as measured along the x-axis.

From curvature plot 244 it is readily seen that the extrinsic curvature of groove 148 (FIG. 2B) has two discontinuities D1, D2 corresponding to transition segments TS1 and TS2 (FIGS. 2A and 2B). Discontinuities D1, D2 are due to the curvature of groove 148 changing direction within each transition segment TS1 and TS2. That is, traversing groove 148 of FIG. 2B from left to right in the figure, discontinuity D1 is due to transition segment TS1 transitioning generally leftward from radial inner edge flow control segment CS1 to counterclockwise-wound intermediate flow control segment CS2, and discontinuity D2 is due to transition segment TS2 transitioning generally rightward from intermediate flow control segment CS2 to radial outer edge flow control segment CS3.

In the present example, each of inner and outer edge flow control segments CS1, CS3 is linear and intermediate flow control segment CS2 is an arc of a spiral curve. As is illustrated below in further examples, the configuration of each flow control segment CS1–CS3 may be different from the configuration shown. For example, any one of flow control segments CS1–CS3 may be linear, an arc of a spiral, an arc of a circle or an arc of another curved shape, such as an ellipse. Generally, the configurations of flow control segments CS1–CS3 follow from the designing of polishing pad to achieve a particular result, such as for example a uniform removal rate from the wafer center to the wafer edge.

It is noted that discontinuities D1, D2 are in opposite directions from one another, i.e., one of the discontinuities (D1) corresponds to an increase in extrinsic curvature and the other discontinuity (D2) corresponds to a decrease in extrinsic curvature, as viewed from left to right along groove 148. This is necessarily so in any groove, such as groove 148, having three flow control segments, such as flow control segments CS1–CS3, and in which the inner and outer flow control segments have the same orientations as each other and different from the orientation of the intermediate flow control segment. When each such groove (148) has three flow control segments (CS1–CS3) and two transition segments (TS1, TS2), in order to achieve the benefits of the invention each of the inner and outer edge flow control segments (CS1, CS3) must be at least partially within polishing track (122) (they will be entirely within the polishing track if they do not extend across inner and outer boundaries). As a result, each transition segment (TS1, TS2) and intermediate flow control segment (CS2) will be entirely within polishing track (122). Consequently, there must be some sort of limit on the widths of each of the five zones, i.e., flow control zones CZ1–CZ3 and the two transition zones TZ1, TZ2.

Practically speaking, it is presently preferred that the width $W_T$ of each transition zone (e.g., TZ1, TZ2) be no greater than width $W_P$ of the polishing track divided by twice the number N of discontinuities (e.g., D1, D2), or $W_T \leqq W_P/(2N)$. It is even more preferred that the width $W_T$ of each transition zone be no greater than width $W_P$ of polishing track divided by four times the number N of discontinuities, or $W_T \leqq W_P/(4N)$ so that each flow control zone CZ1–CZ3 may have a reasonable width $W_C$. As noted above, it is often desirable to configure grooves 148 so that their inner and outer edge flow control segments CS1, CS3 have substantially the same effect on the region of wafer 112 adjacent the wafer's edge. As a result, it is often desirable, but not necessary, to make the widths $W_C$ of flow control zones CZ1, CZ3 equal, or substantially so, to one another.

A discontinuity, such as each of discontinuities D1, D2, will generally be any one of three types, depending upon the configuration of the corresponding transition segments TS1, TS2. A first type of discontinuity occurs as a "spike" in the curvature plot and may be termed a "gradual" discontinuity. Referring to FIG. 2D, both of discontinuities D1, D2 are of the spike type. Generally, the spike type is characterized by the spike at issue, e.g., spikes S1, S2, having a non-zero width $W_T$, which corresponds to the width of the corresponding transition zone, e.g., transition zones TZ1, TZ2 in the example shown in FIGS. 2A and 2B. When a discontinuity is of the spike type, the corresponding transition portion of slope plot 240, e.g., transition portions TP1, TP2 of FIG. 2C in the example, is generally non-vertical.

Figure 3A:
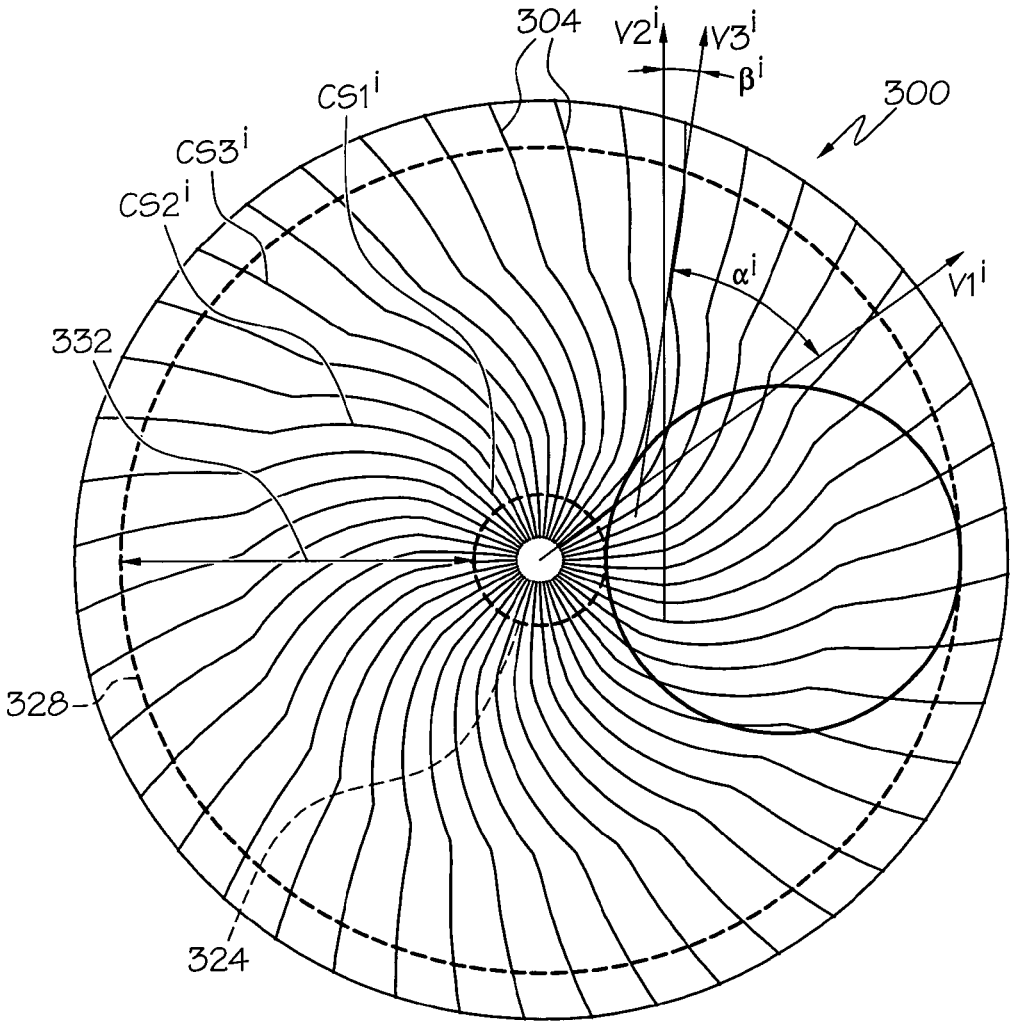
FIG. 3A is a plan view of a polishing pad of the present invention containing a plurality of grooves each having three positive-curvature flow control segments and two sharp discontinuities in slope within the polishing track.
Figure 3B:
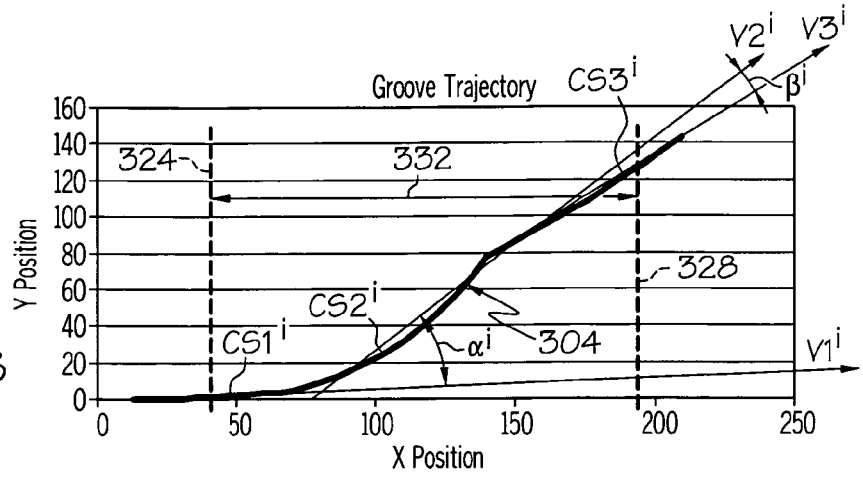
FIG. 3B is plot of the trajectory of each groove of FIG. 3A.
Figure 3C:
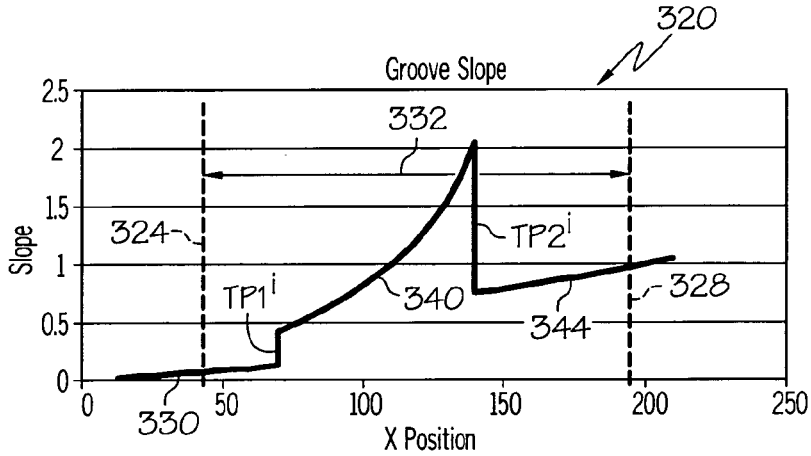
FIG. 3C is a plot of the slope of the trajectory of each groove of FIG. 3A.
Figure 3D:
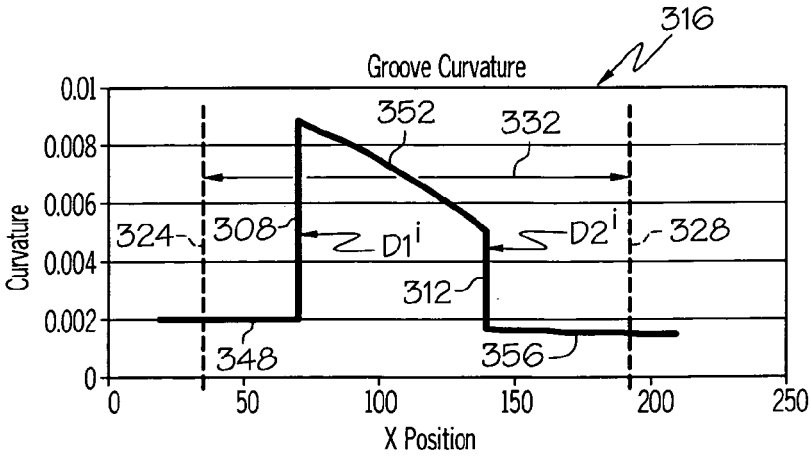
FIG. 3D is a plot of the extrinsic curvature of the trajectory of each groove of FIG. 3A.

Referring now to FIGS. 3A–D, FIGS. 3A and 3B show a polishing pad 300 having a plurality of like grooves 304 that are generally similar to grooves 148 of FIGS. 2A and 2B, but have positively curved inner and outer edge flow control segments $CS1^i$, $CS3^i$ in lieu of the linear inner and outer edge flow control segments CS1, CS3 of FIGS. 2A and 2B. It is noted that each flow control segment $CS1^i$–$CS3^i$ is an arc of a spiral. As with grooves 148 of FIGS. 2A and 2B, each flow control segment $CS1^i$–$CS3^i$ may have another shape. The direction vector $V1^i$–$V3^i$ of each control segment $CS1^i$–$CS3^i$ is given by the transverse centerline of the groove trajectory in the respective flow control zone. The angle $\alpha^i$ is formed by the intersection of direction vector $V1^i$ and direction vector $V2^i$. The angle $\beta^i$ is formed by the intersection of direction vector $V2^i$ and direction vector $V3^i$. In addition, each groove 304 has a second type of discontinuity $D1^i$, $D2^i$, which generally occurs as a vertical line 308, 312 (FIG. 3D) in the corresponding curvature plot 316. A sharp discontinuity generally does not have a width $W_T$ as occurs in the spike type, or gradual, discontinuity (such as discontinuities D1, D2 of FIG. 2D) and may be termed a "sharp" discontinuity. In the present example, both discontinuities $D1^i$, $D2^i$ in FIG. 3D are sharp discontinuities. Correspondingly, the transition portions $TP1^i$, $TP2^i$ of slope plot 320 corresponding to discontinuities $D1^i$, $D2^i$ are likewise vertical, indicating the sharpness of the transitions. Other features of grooves 304 of FIGS. 3A and 3B may be the same as grooves 148 of FIGS. 2A and 2B. For example, inner and outer edge flow control segments $CS1^i$, $CS3^i$ may, but need not necessarily, extend across the inner and outer boundaries 324, 328 of polishing track 332, and may have substantially the same orientations and curvatures as one another. In addition, each flow control segment $CS1^i$–$CS3^i$ may have any desired orientation and curvature suitable for a particular purpose. Again, it is noted that discontinuities $D1^i$, $D2^i$ both occur within polishing track 332.

A third type of discontinuity (not shown) that is possible may be termed an "abrupt" discontinuity, which is formed when the transition is essentially a corner between two flow control segments, i.e., the transition zone has a zero width. The slope plot (not shown) of a groove having an abrupt discontinuity would have a "jump" corresponding to the abrupt discontinuity. Referring to FIGS.: 3A–3D, if groove 304 had two abrupt discontinuities instead of two sharp discontinuities $D1^i$, $D1^i$, slope plot 320 of FIG. 3C would have only the portions 330, 340, 344 corresponding to flow control segments $CS1^i$–$CS3^i$. That is, vertical transition portions $TP1^i$, $TP2^i$ would not be present since the slope would "jump" across the corner, without any transition in between. Correspondingly, the curvature plot (not shown) would also have jumps at the two discontinuities. Consequently, the curvature plot would look similar to curvature plot 316 of FIG. 3D, but would lack the vertical portions 308, 312. Only the portions 348, 352, 356 corresponding to three flow control segments $CS1^i$–$CS3^i$ would be present.

Figure 4A:
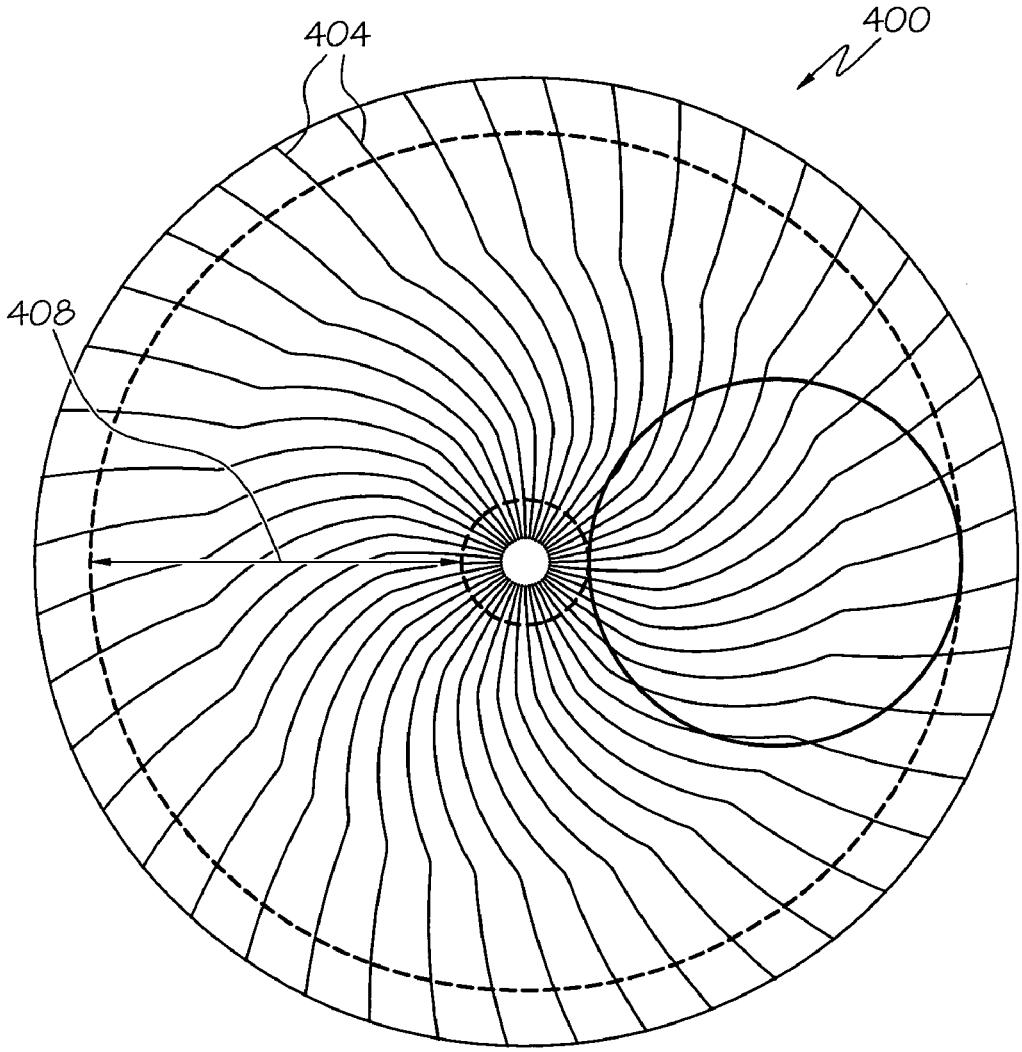
FIG. 4A is a plan view of a polishing pad of the present invention containing a plurality of grooves each having three positive-curvature flow control segments and two gradual discontinuities in slope within the polishing track.
Figure 4B:
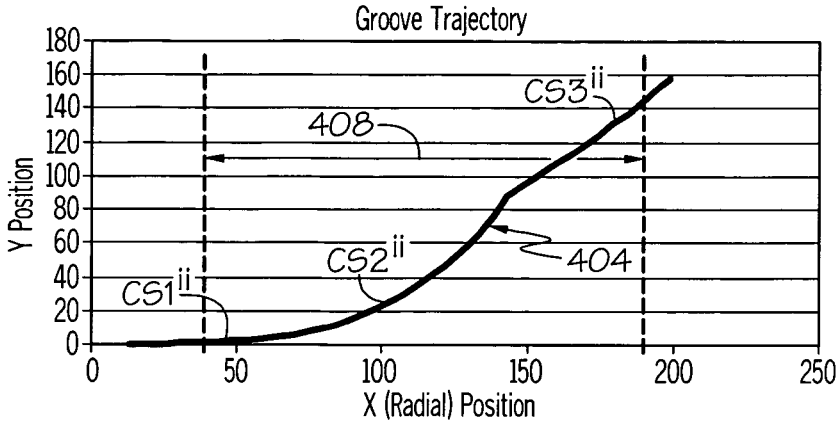
FIG. 4B is plot of the trajectory of each groove of FIG. 4A.
Figure 4C:
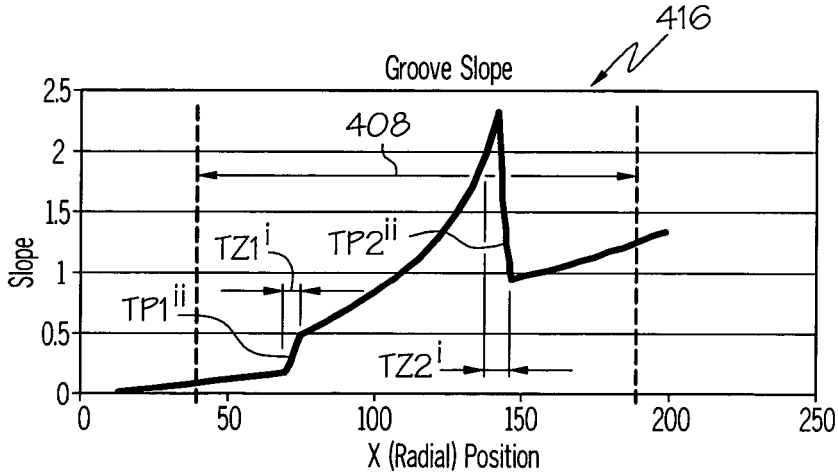
FIG. 4C is a plot of the slope of the trajectory of each groove of FIG. 4A.
Figure 4D:
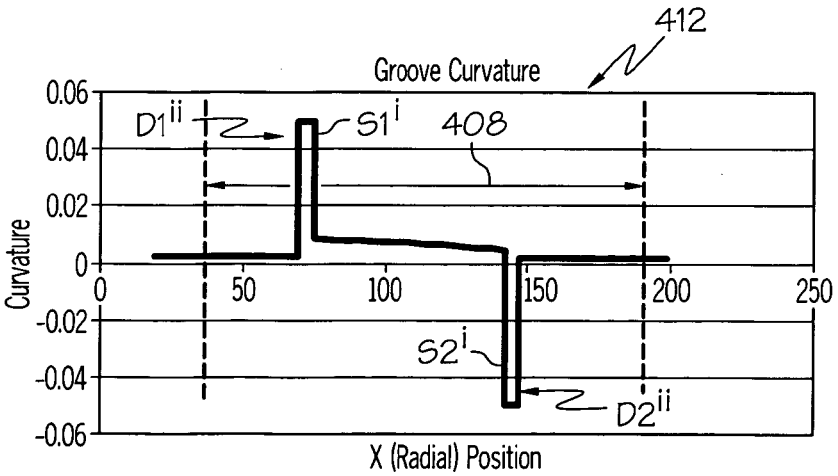
FIG. 4D is a plot of the extrinsic curvature of the trajectory of each groove of FIG. 4A.
Figure 5A:
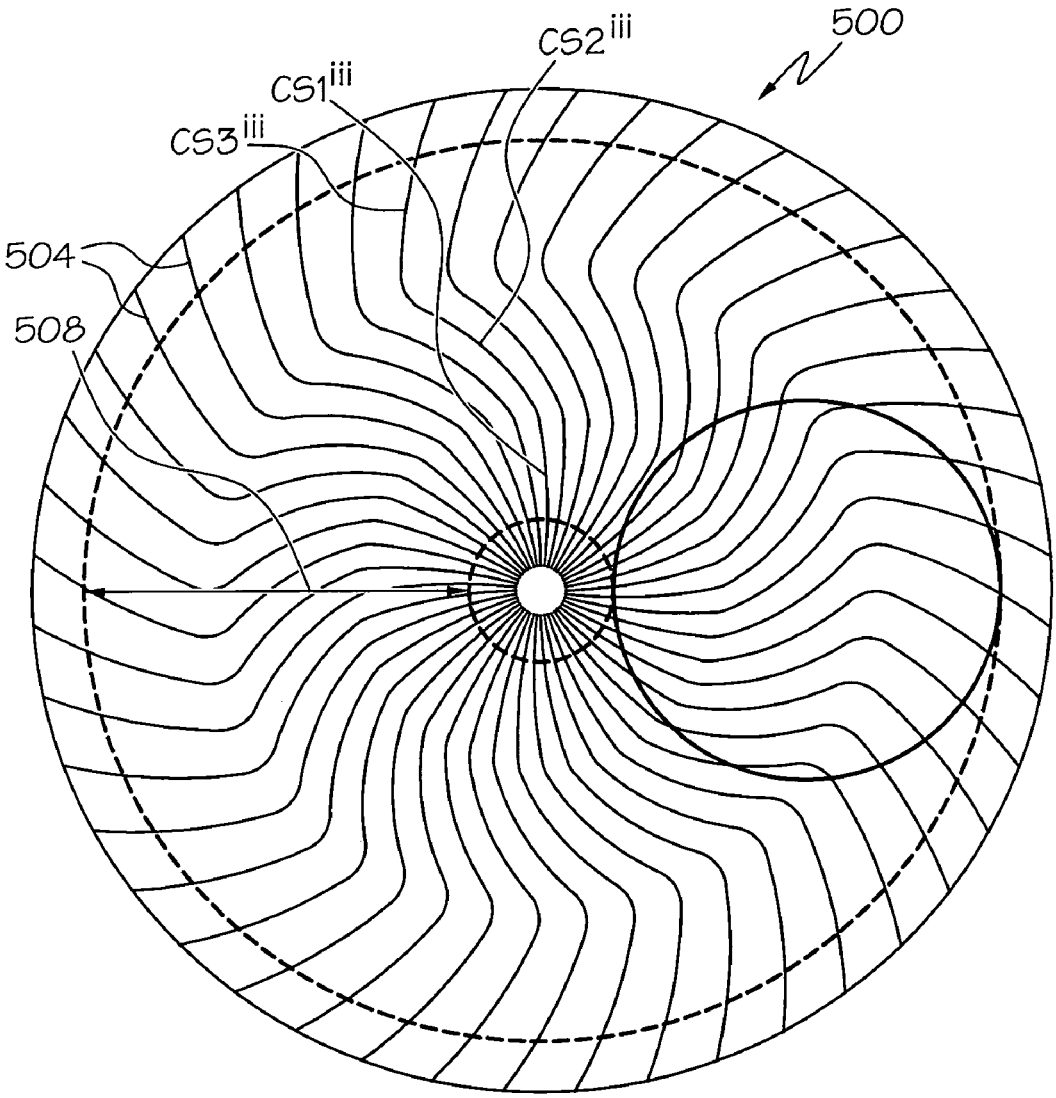
FIG. 5A is a plan view of a polishing pad of the present invention containing a plurality of grooves each having two positive-curvature flow control segments, one negative curvature flow control segment and two unequal-width gradual discontinuities in slope within the polishing track.
Figure 5B:
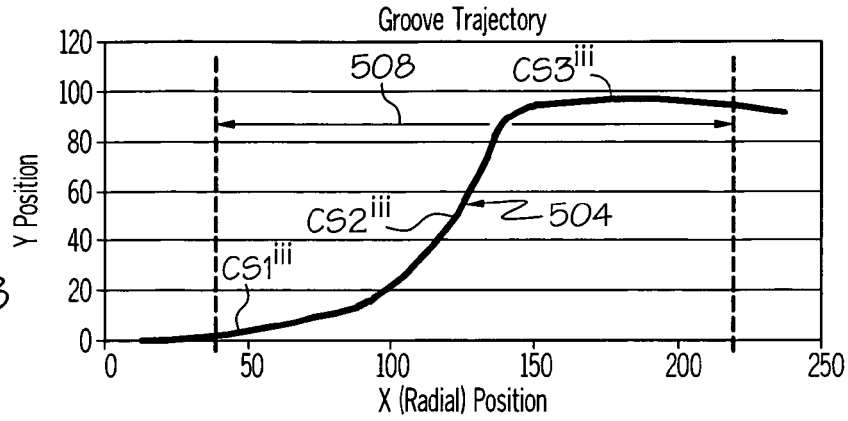
FIG. 5B is a plot of the trajectory of each groove of FIG. 5A.
Figure 5C:
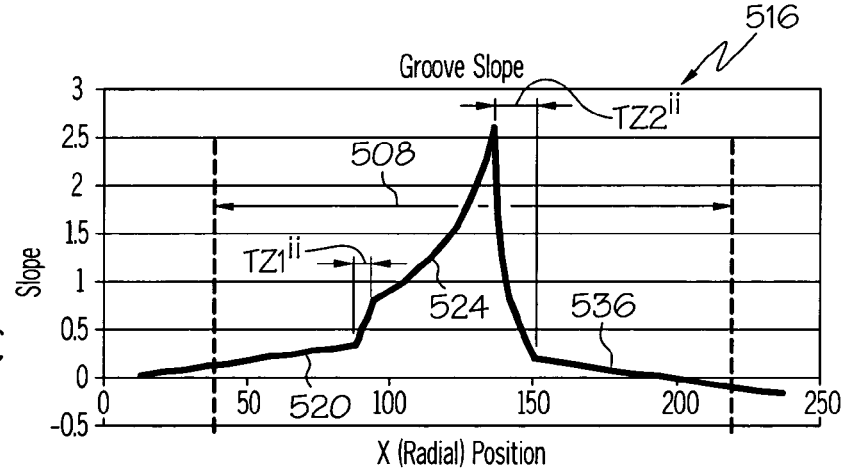
FIG. 5C is a plot of the slope of the trajectory of each groove of FIG. 5A.
Figure 5D:
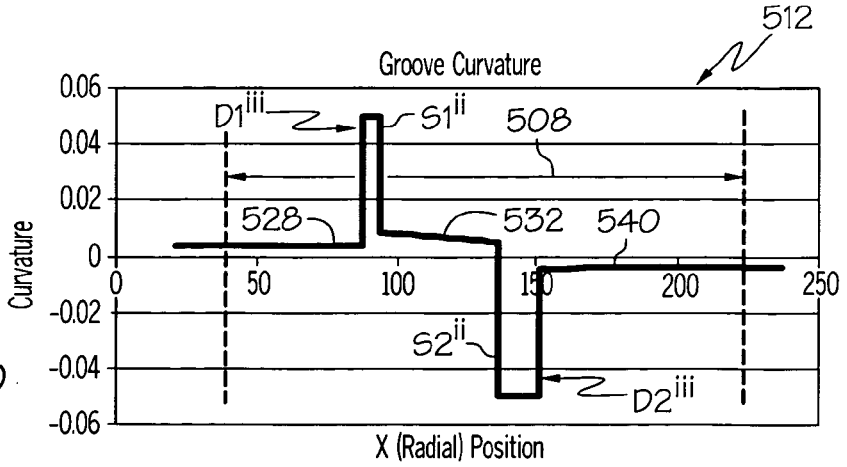
FIG. 5D is a plot of the extrinsic curvature of the trajectory of each groove of FIG. 5A.

Referring to FIGS. 4A–4D, FIG. 4A illustrates a polishing pad 400 of the present invention having a plurality of like grooves 404 that are substantially the same as grooves 304 of FIG. 3A, except that grooves 404 of FIG. 4A each have two gradual discontinuities $D1^{ii}$, $D2^{ii}$ (FIG. 4D) within polishing track 408 rather than sharp discontinuities $D1^i$, $D1^i$ (FIG. 3D) of grooves 304 of polishing pad 300. (FIG. 4B shows one of grooves 404 reproduced in a coordinate system convenient for analyzing the slope and curvature of the grooves.) Again, as discussed above in connection with FIGS. 2C and 2D, gradual discontinuities, such as discontinuities D1$^{ii}$, D2$^{ii}$, are generally characterized by spikes S1$^{i}$, S2$^{i}$ in curvature plot 412 (FIG. 4D) and transition portions TP1$^{ii}$, TP2$^{ii}$ of slope plot 416 of FIG. 4C being sloped within the transition zones TZ1$^{i}$, TZ2$^{i}$. All other aspects of grooves 404 may be identical to grooves 304 of FIGS. 3A and 3B, such as in curvature and orientation, among others. Of course, however, grooves 404 may differ in these and other aspects, e.g., in curvature and orientation and length of flow control segments, etc. as described above in connection with grooves 148 of FIGS. 2A and 2B. It is noted that in each groove 404 of pad 400, the slope of each flow control segment CS1$^{ii}$–CS3$^{ii}$ is positive, i.e., each segment curves to the left proceeding from the radially inward end of the corresponding groove to the radially outward end relative to the pad.

FIGS. 5A–5D are directed to another polishing pad 500 of the present invention in which flow control segments CS1$^{iii}$, CS2$^{iii}$ of grooves 504 have positive slopes and flow control segment CS3$^{iii}$ has a negative slope relative to the traversal of the grooves from their radially inward ends to radially outward ends. Correspondingly, each groove 504 has two discontinuities D1$^{iii}$, D2$^{iii}$ within polishing track 508. In this example, discontinuities D1$^{iii}$, D2$^{iii}$ are of the gradual type, as characterized by spikes S1$^{ii}$, S2$^{ii}$ in curvature plot 512. In this case, the widths of discontinuities D1$^{iii}$, D2$^{iii}$, and correspondingly the widths of the transition zones TZ1$^{ii}$, TZ2$^{ii}$ are markedly different from each other. The positive nature of the curvature of flow control segments CS1$^{iii}$, CS2$^{iii}$ is clearly shown in slope plot 516 of FIG. 5C by the upward trend of portions 520, 524 and in curvature plot 512 of FIG. 5D and by portions 528, 532 indicating positive values. Correspondingly, the negative nature of the curvature of flow control segment CS3$^{iii}$ is readily seen in slope plot 516 of FIG. 5C by the downward trend of portion 536 and in curvature plot 512 of FIG. 5D by portion 540 indicating negative values. In this example, all flow control segments CS1$^{iii}$–CS3$^{iii}$ are shown as being spiral arcs. Again, however this need not be so. Flow control segments CS1$^{iii}$–CS3$^{iii}$ may each have any shape desired to meet the design requirements for a particular application.

Figure 6A:
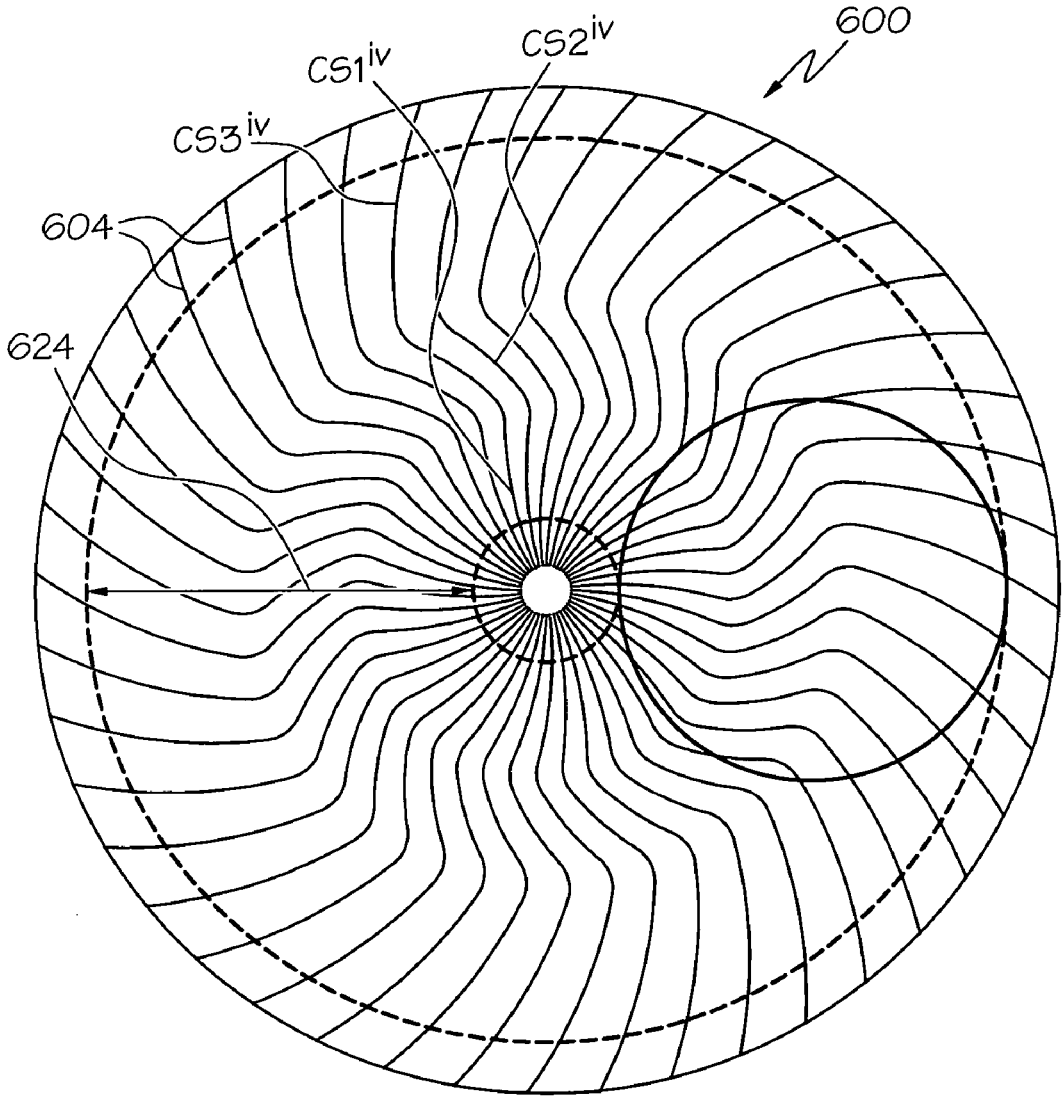
FIG. 6A is a plan view of a polishing pad of the present invention containing a plurality of grooves each having one positive-curvature flow control segment, two negative curvature flow control segments and two gradual discontinuities in slope within the polishing track.
Figure 6B:
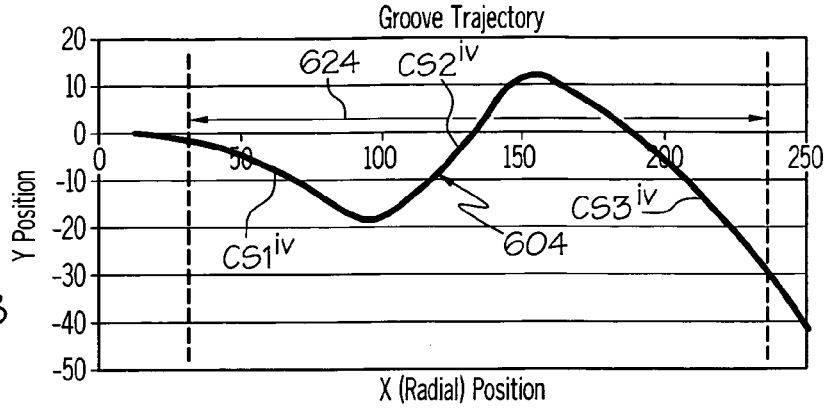
FIG. 6B is a plot of the trajectory of each groove of FIG. 6A.
Figure 6C:
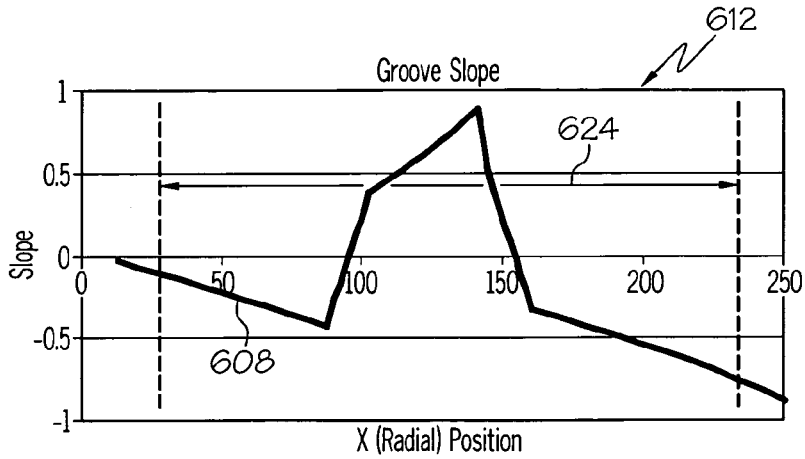
FIG. 6C is a plot of the slope of the trajectory of each groove of FIG. 6A.
Figure 6D:
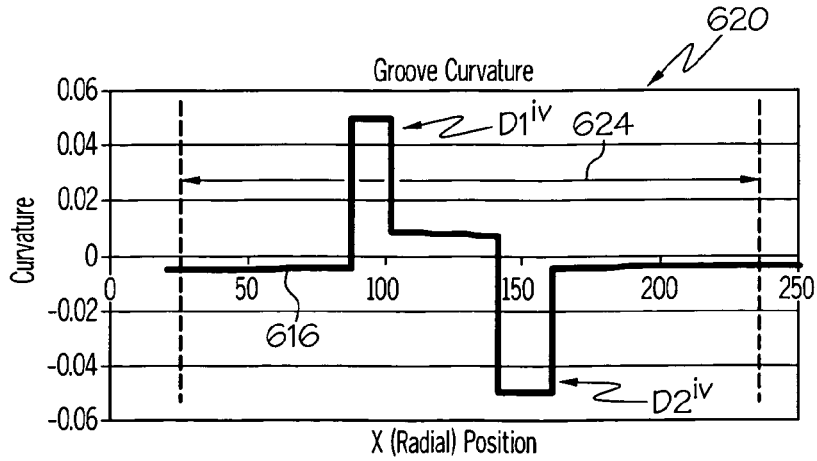
FIG. 6D is a plot of the extrinsic curvature of the trajectory of each groove of FIG. 6A.
Figure 7A:
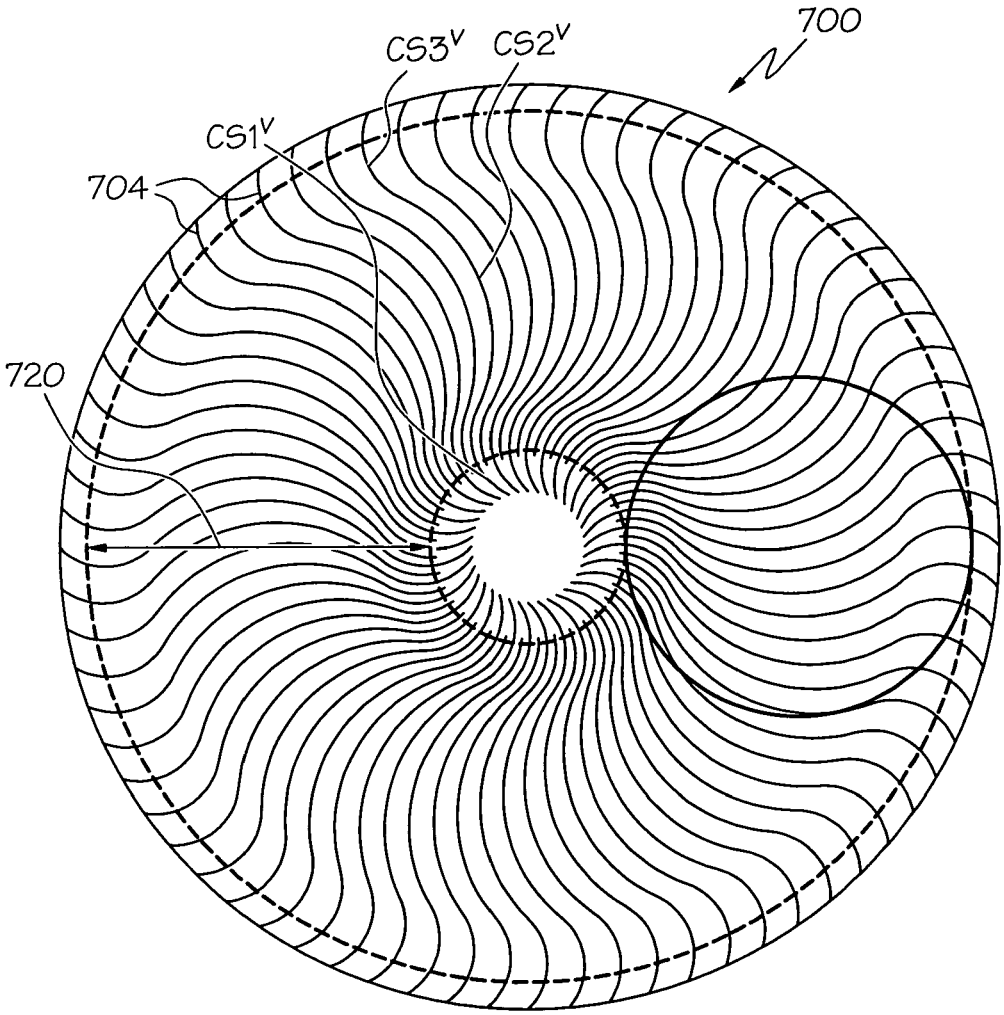
FIG. 7A is a plan view of a polishing pad of the present invention containing a plurality of grooves each having three circular-arc flow control segments and two gradual discontinuities in slope within the polishing track.
Figure 7B:
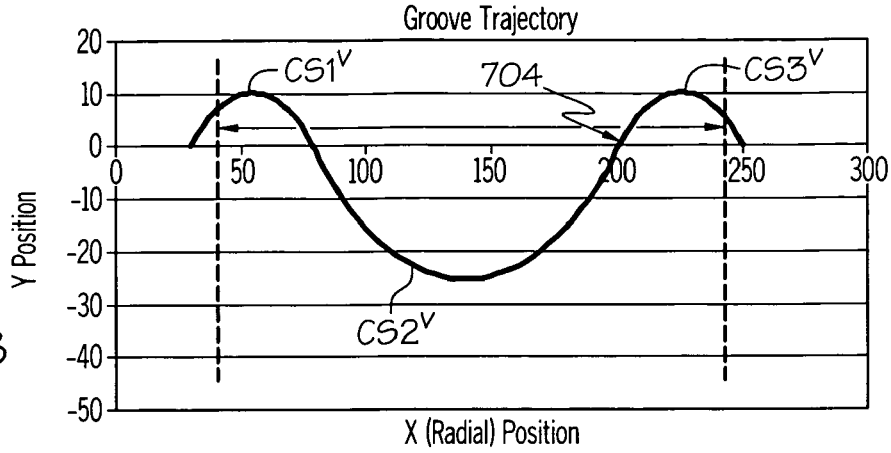
FIG. 7B is a plot of the trajectory of each groove of FIG. 7A.
Figure 7C:
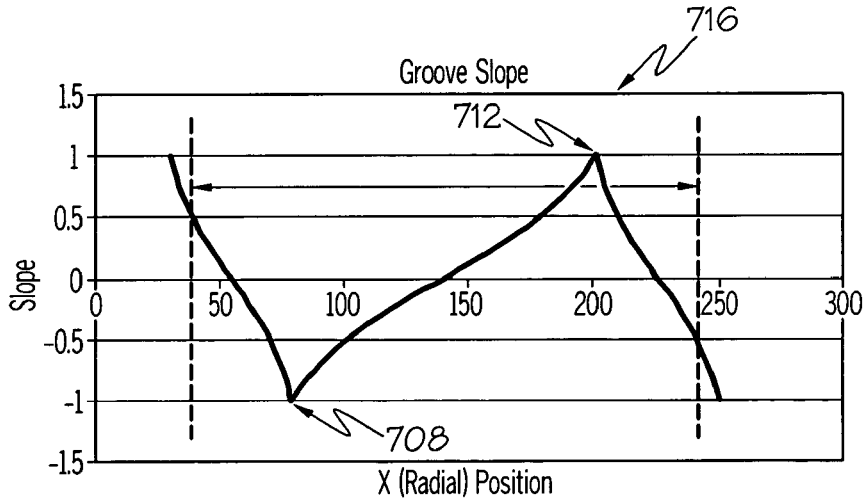
FIG. 7C is a plot of the slope of the trajectory of each groove of FIG. 7A.
Figure 7D:
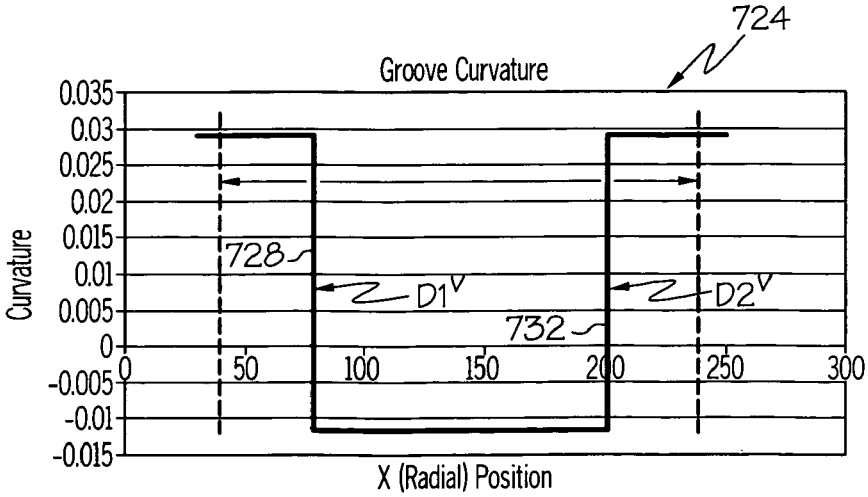
FIG. 7D is a plot of the extrinsic curvature of the trajectory of each groove of FIG. 7A.

FIGS. 6A–6D illustrate a polishing pad 600 and corresponding grooves 604 of the present invention that are generally similar to polishing pad 500 and grooves 504 of FIGS. 5A–5D, except that instead of flow control segments CS1$^{iv}$ having positive curvature as in flow control segments CS1$^{iii}$ of FIGS. 5A–5D, flow control segments CS1$^{iv}$ have negative curvature. The negative curvature is readily seen in the downward trend of portion 608 of slope plot 612 in FIG. 6C and in portion 616 of curvature plot 620 of FIG. 6D which indicates negative values. The curvatures of flow control segments CS2$^{iv}$, CS3$^{iv}$ are, respectively, positive and negative in a manner similar to the curvatures of flow control segments CS2$^{iii}$, CS3$^{iii}$ of FIGS. 5A and 5B. The two discontinuities D1$^{iv}$, D2$^{iv}$ (FIG. 6D) of each groove 604 are, like discontinuities D1$^{iii}$, D2$^{iii}$, are gradual, of unequal length and occur within polishing track 624. Again, all flow control segments CS2$^{iv}$–CS3$^{iv}$ of FIGS. 6A and 6B are shown as being spiral arcs, but need not be so.

FIGS. 7A–7D are directed to a polishing pad 700 of the present invention containing a plurality of like grooves 704 each having three circular-arc flow control segments CS1$^{v}$–CS3$^{v}$ connected to one another by two very short transitions 708, 712 (see slope plot 716 of FIG. 7C) within the polishing track 720. As seen in curvature plot 724 of FIG. 7D, discontinuities D1$^{v}$, D2$^{v}$ at transition segments 708, 712 are sharp discontinuities, as evidenced by the two vertical portions 728, 732.

Figure 8A:
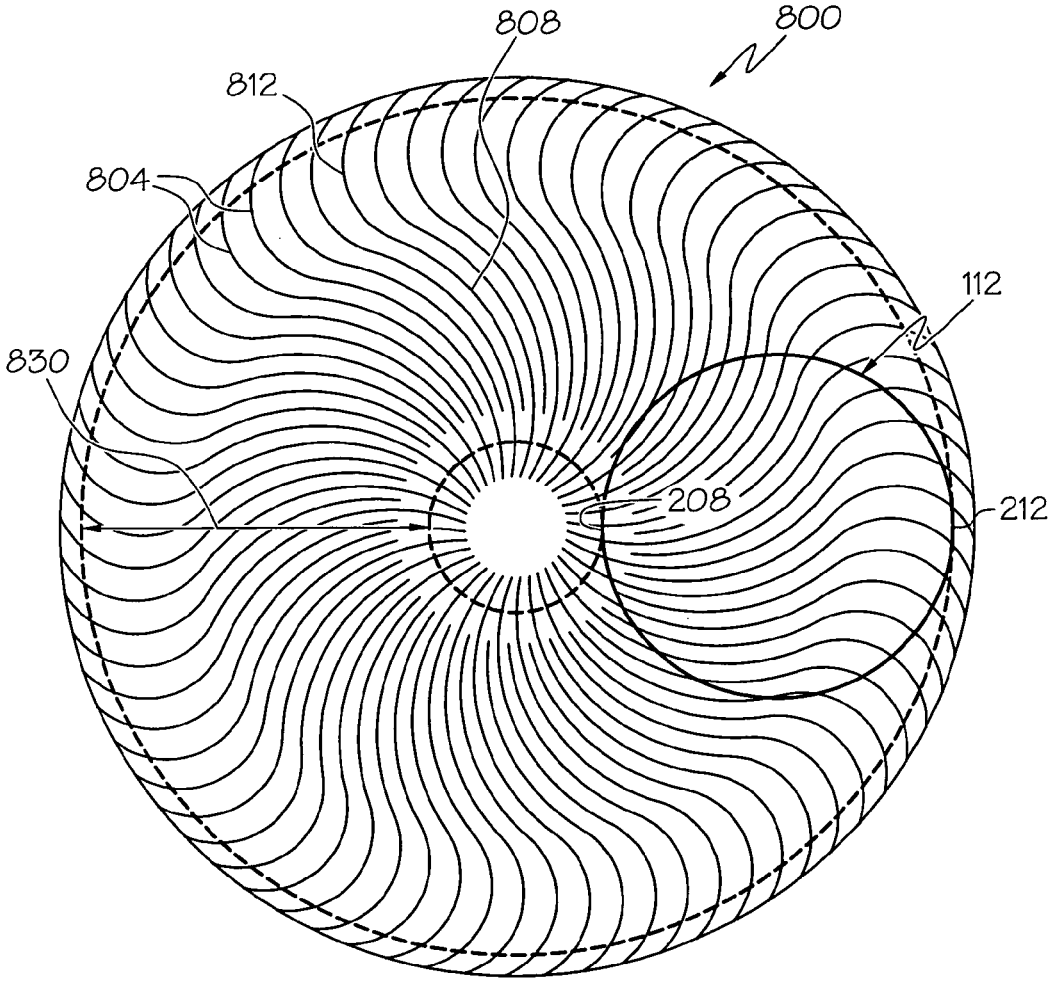
FIG. 8A (PRIOR ART)
FIG. 8A is a plan view of a prior art polishing pad of containing a plurality of grooves each having two circular-arc segments and one gradual discontinuity in slope within the polishing track.
Figure 8B:
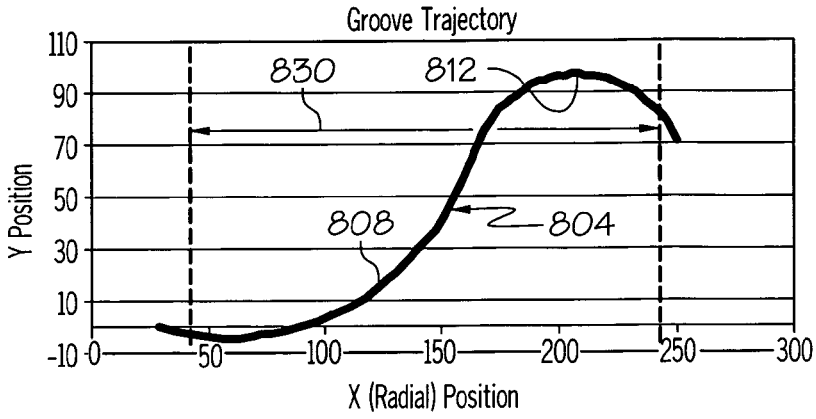
FIG. 8B (PRIOR ART)
FIG. 8B is a plot of the trajectory of each prior art groove of FIG. 8A.
Figure 8C:
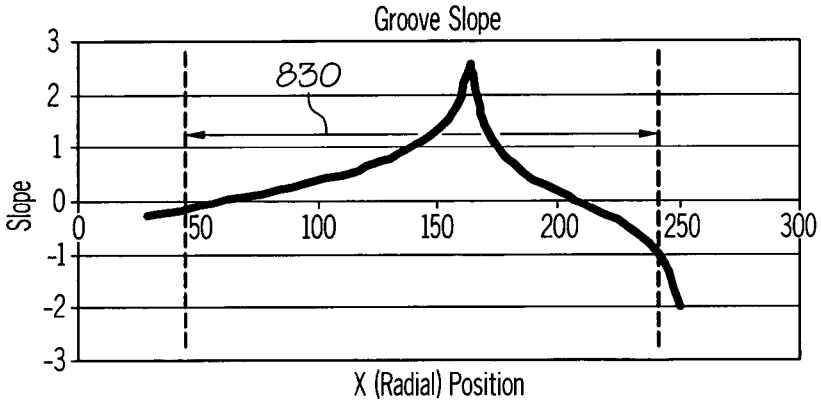
FIG. 8C (PRIOR ART)
FIG. 8C is a plot of the slope of the trajectory of each prior art groove of FIG. 8A.
Figure 8D:
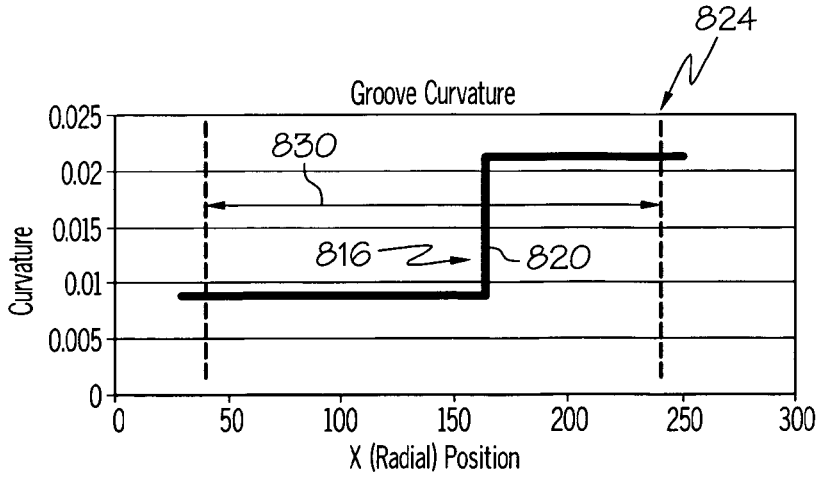
FIG. 8D (PRIOR ART)
FIG. 8D is a plot of the extrinsic curvature of the trajectory of each prior art groove of FIG. 8A.
Figure 9A:
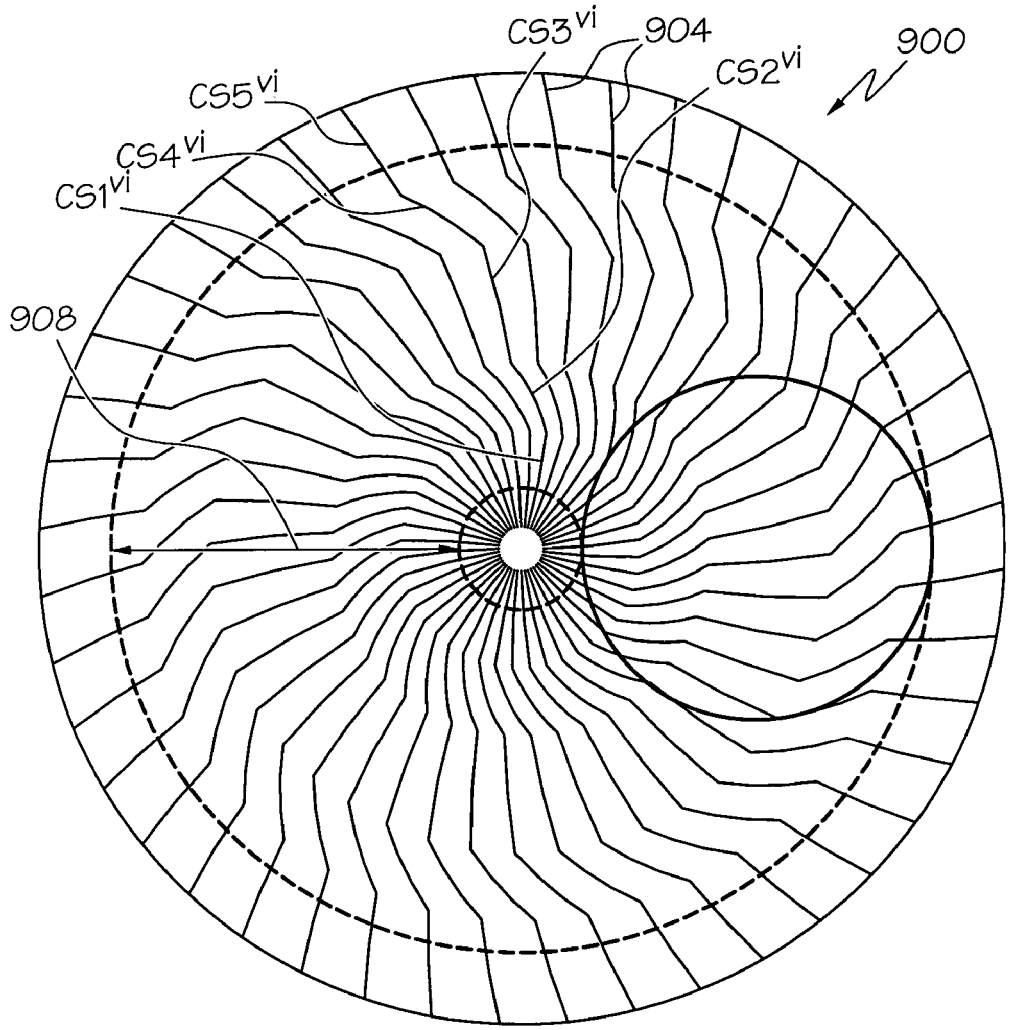
FIG. 9A is a plan view of a polishing pad of the present invention containing a plurality of grooves each having five positive-curvature flow control segments and four sharp discontinuities in slope within the polishing track.
Figure 9B:
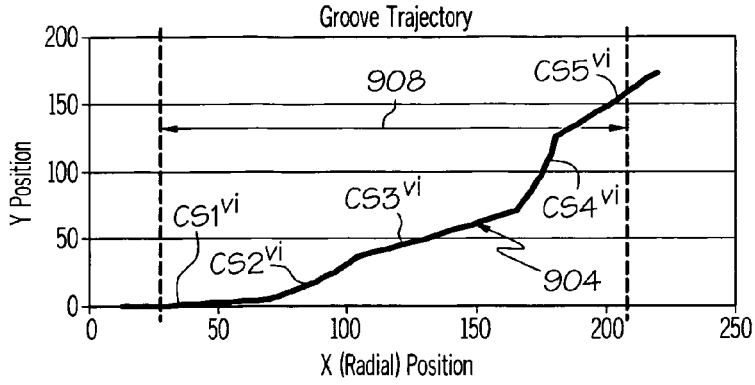
FIG. 9B is a plot of the trajectory of each groove of FIG. 9A.
Figure 9C:
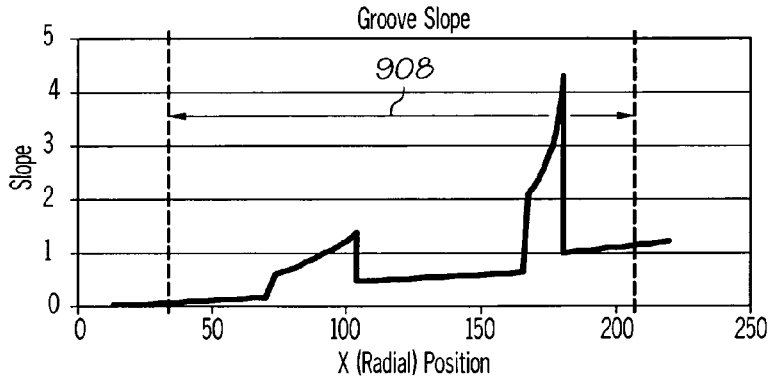
FIG. 9C is a plot of the slope of the trajectory of each groove of FIG. 9A.
Figure 9D:
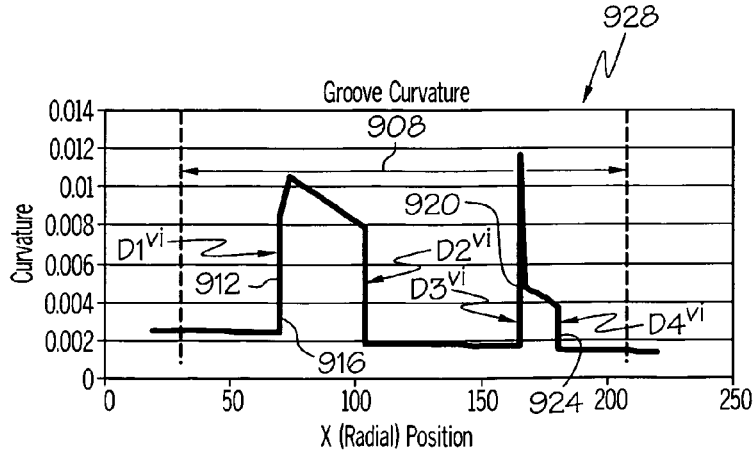
FIG. 9D is a plot of the extrinsic curvature of the trajectory of each groove of FIG. 9A.

For the sake of comparing polishing pad 700 and its grooves 704, as shown in FIGS. 7A–7D, FIGS. 8A–8D show a prior art polishing pad 800 and its prior art grooves 804 configured in accordance with the subject matter of Korean Patent Application Publication No. 1020020022198 to Kim et al. mentioned in the Background section above. Similar to grooves 704 of FIGS. 7A and 7B, prior art grooves 804 of FIGS. 8A and 8B are made of circular segments. However, each prior art groove 804 has only two circular segments 808, 812, in contrast to the three segments CS1$^{v}$–CS3$^{v}$ shown in FIGS. 7A and 7B. Consequently, each prior art groove 804 has only a single discontinuity 816, in this case a sharp discontinuity, as indicated by the vertical portion 820 of the curvature plot 824 of FIG. 8D. While single discontinuity 816 is located within the polishing track 830, the fact that there is only one discontinuity is in stark contrast with polishing pad 700 of FIGS. 7A–7D, which has two discontinuities D1$^{v}$, D2$^{v}$, both of which occur within polishing track 708. With only a single discontinuity 816 within each of its grooves 804, prior art polishing pad 800 of FIGS. 8A–8D cannot provide any of a number of benefits that a polishing pad of the present invention can provide. Importantly, prior art polishing pad 800 cannot treat the radially inner and outer edges 208, 212 of wafer 112 (FIG. 8A) the same as each other. Consequently, prior art pad 800 cannot achieve the same polishing characteristics as a polishing pad of the present invention, e.g., polishing pads 104, 200, 300, 400, 500, 600, 700, 900.

As mentioned above in connection with FIGS. 2A–2D, a polishing pad of the present invention need not be constrained to having only three flow control segments and two corresponding discontinuities. On the contrary, a polishing pad of the present invention may have four or more flow control segments and, correspondingly, three or more discontinuities each located between two corresponding flow control segments. For example, FIGS. 9A–9D are directed to a polishing pad 900 of the present invention that includes a plurality of like grooves 904 each having five flow control segments CS1$^{vi}$, CS2$^{vi}$, CS3$^{vi}$, CS4$^{vi}$, CS5$^{vi}$ (FIGS. 9A and 9B) and four discontinuities D1$^{vi}$, D2$^{vi}$ , D3$^{vi}$, D4$^{vi}$ (FIG. 9D), all of which occur within polishing track 908. In the present example, all flow control segments CS1$^{vi}$, CS2$^{vi}$, CS3$^{vi}$, CS4$^{vi}$, CS5$^{vi}$ are spiral arcs and all have positive curvature. Like the flow control segments of other polishing pads of the present invention, e.g., pads of FIGS. 2A, 3A, 4A, 5A, 6A and 7A, control segments CS1$^{vi}$, CS2$^{vi}$, CS3$^{vi}$, CS4$^{vi}$, CS5$^{vi}$ of pad of FIG. 9A may have any shape and curvature desired to suit a particular design. It is noted that each discontinuity D1$^{vi}$, D2$^{vi}$, D3$^{vi}$, D4$^{vi}$ is a sharp discontinuity, being characterized largely by corresponding vertical portions 912, 916, 920, 924 of curvature plot 928 of FIG. 9D. In other embodiments, discontinuities D1$^{vi}$, D2$^{vi}$, D3$^{vi}$, D4$^{vi}$ may be all of another type, i.e., gradual or abrupt, or may be any combination of gradual, sharp and abrupt type discontinuities as desired.

As touched on above, a reason for partitioning polishing track into three or more flow control zones is to allow a pad designer to customize polishing pads to the polishing operation at hand in order to enhance polishing as much as possible. Generally, a designer accomplishes this by understanding how flow of a polishing medium in the gap between the wafer and polishing pad in the multiple zones affects polishing. For example, certain polishing benefits from having the polishing medium in the flow control zones near the edges of the wafer, e.g., zones CZ1 and CZ3 in the embodiment of FIG. 2A, flow through these flow control zones relatively quickly so as to reduce the resident time of the polishing medium in these zones. In this same type of polishing, it may also be desirable that the polishing medium have longer residence times in the central portion of the wafer, e.g., in flow control zone CZ2 of FIG. 2A. In this case, the designer may choose to provide the pad with highly radial groove segments CS1 and CS3 in flow control zones CZ1 and CZ3 that promote the flow of the polishing medium and with more circumferential groove segments CS2 in flow control zone CZ2 that inhibit the flow of the polishing medium. In this manner, a designer can customize the profile of the polishing medium flow radially across the polishing track. In other types of polishing, the opposite may be desirable. That is, in other types of polishing, relatively long residence times in flow control zones CZ1 and CZ3 and relatively short residence times in flow control zone CZ2 may be desirable. During polishing, the substrate preferably contacts at least three flow control zones to adjust removal rate in corresponding regions of the substrate. Thus, adjusting the extrinsic curvature in different control zones can provide profile adjustment, such as correcting a center-high or edge-high wafer profile.

The invention claimed is:

1. A polishing pad, comprising:

a) a polishing layer configured for polishing at least one of a magnetic, optical and semiconductor substrate in the presence of a polishing medium, the polishing layer having a rotational center and including an annular polishing track concentric with the rotational center and having a width; and b) a plurality of grooves, located in the polishing layer, each traversing the entirety of the width of the annular polishing track and including an extrinsic curvature having at least two discontinuities within the annular polishing track, the at least two discontinuities being in opposite directions from one another and providing an increase and decrease in value of the extrinsic curvature, and having a first direction radially inward of the first discontinuity, a second direction in between the first discontinuity and the second discontinuity, and a third direction radially outward of the second discontinuity, and the change in direction between at least one pair of adjacent directions is from −85 degrees to 85 degrees.

2. The polishing pad according to claim 1, wherein the at least two discontinuities of each of the grooves partition that groove so as to have an inner edge flow control segment, an outer edge flow control segment and at least one intermediate flow control segment located between the inner edge flow control segment and the outer edge flow control segment.

3. The polishing pad according to claim 2, wherein the inner edge flow control segment has a first orientation and a first curvature and the outer edge flow control segment has a second orientation and a second curvature each the same as the first orientation and the first curvature.

4. The polishing pad according to claim 3, wherein each of the first and second orientations is radial.

5. The polishing pad according to claim 3, wherein each of the first and second curvatures is zero.

6. The polishing pad according to claim 1, wherein each of the grooves has at least three discontinuities in curvature and wherein adjacent ones of the at least three discontinuities are in opposite directions from one another.

7. The polishing pad according to claim 1, wherein the annular polishing track has a circular inner boundary and a circular outer boundary spaced apart by the width, each of the grooves having an inner edge flow control segment that crosses the inner boundary and an outer edge flow control segment that crosses the outer boundary.

8. The polishing pad according to claim 1, wherein N represents a number and each groove has N discontinuities, N transitions occurring at the N discontinuities, and N+1 flow control segments located alternatingly with the N transitions, each of the N transitions having a width no greater than the width of the polishing track divided by 2N.

9. The polishing pad according to claim 8, wherein the width of each of the N transitions is no greater than the width of the polishing track divided by 4N.

10. A method of polishing at least one of a magnetic, optical and semiconductor substrate in the presence of a polishing medium, including:

a) polishing with a polishing pad, the polishing pad comprising: i) a polishing layer configured for polishing at least one of a magnetic, optical and semiconductor substrate in the presence of a polishing medium, the polishing layer having a rotational center and including an annular polishing track concentric with the rotational center and having a width, the annular track having at least three flow control zones; and ii) a plurality of grooves, located in the polishing layer, each traversing the entirety of the width of the annular polishing track and including an extrinsic curvature having at least two discontinuities within the annular polishing track, the at least two discontinuities being in opposite directions from one another and providing an increase and decrease in value of the extrinsic curvature, and having a first direction radially inward of the first discontinuity, a second direction in between the first discontinuity and the second discontinuity, and a third direction radially outward of the second discontinuity, and the change in direction between at least one pair of adjacent directions is from −85 degrees to 85 degrees; and b) adjusting removal rate of the substrate with each of the at least three flow control zones.

* * * * *